United States Patent [19]

Ritchie

[11] 4,384,423

[45] May 24, 1983

[54] FIRING MECHANISM FOR MUZZLE-LOADING FIREARMS

[76] Inventor: Vernon C. Ritchie, 924 Myra St., Denham Springs, La. 70726

[21] Appl. No.: 220,795

[22] Filed: Dec. 29, 1980

[51] Int. Cl.[3] ..... F41C 27/00

[52] U.S. Cl. ..... 42/83

[58] Field of Search ..... 42/83, 51

[56] References Cited

U.S. PATENT DOCUMENTS

| | | | |
|---|---|---|---|
| 3,780,464 | 12/1973 | Anderson | 42/51 |
| 4,114,303 | 9/1978 | Vaughn | 42/51 |
| 4,135,321 | 1/1979 | Lewallyn | 42/83 |
| 4,163,335 | 8/1979 | Ives | 42/83 |
| 4,222,191 | 9/1980 | Lee et al. | 42/51 |
| 4,283,874 | 8/1981 | Vaughn | 42/51 |

*Primary Examiner*—Charles T. Jordan

*Attorney, Agent, or Firm*—David L. Ray

[57] ABSTRACT

A firing mechanism for installation on a muzzle-loading firearm is disclosed. The firing mechanism has a drum means which is attached to the muzzle-loading firearm at a point adjacent its breech. A cap holder fits to the firing mechanism and holds a firing pin. The firing pin fits within a cylinder defined by a portion of the cap holder and drum means. The cylinder defines a closed chamber so that there is no blow back of gases and so that the ignition cap is closed from the exterior of the firearm.

9 Claims, 4 Drawing Figures

FIRING MECHANISM FOR MUZZLE-LOADING FIREARMS

BACKGROUND OF THE INVENTION

This invention relates to an improved firing mechanism which is readily adaptable for use on muzzle-loading firearms whether they are of the rifle or pistol type.

During the evolution of firearms a type of firearm was developed which required that the marksman pack his powder charge and ball through the firearm muzzle. To ignite the powder charge an ignition source was provided externally of the interior of the bore of the firearm barrel. In the earliest times this ignition source was provided by the utilization of a matchlock or a flintlock system which caused ignition of a smaller powder charge which, when ignited, communicated a spark or flame through a flash hole to the main powder charge. As technology developed, this type of ignition system was replaced by the utilization of a percussion cap which provided the ignition source through a flash hole when struck by the firearm hammer. The percussion cap had many advantages over the matchlock and flintlock systems in that it was faster to load and was much more resistant to moisture from rain, dew, etc. This resistance to moisture was a direct result of the fact that the charge is held inside of a small metal cannister and thus was somewhat shielded from these elements.

While the percussion cap was a great advancement over the earlier systems, it suffered drawbacks which were peculiar to its own nature and still did not overcome other drawbacks which are peculiar to the utilization of an ignition source which is exterior to the main charge of the firearm. One drawback which is peculiar to the percussion cap is that it is made of a fragile material which can, on occasion, break apart and become a miniature missile as the main charge ignites. As can be appreciated, this presents a safety problem as such fragments can result in eye injury to the marksman. Since the percussion cap requires utilization of a flash hole it experiences the same drawbacks as the older matchlock and flintlock systems in that there is blow back through the flash hole when the main powder charge ignites. This blow back could be dangerous to the marksman as hot gases and burning powder could be blown back into the marksman's face. This disadvantage was somewhat mitigated by structuring the geometry of the flash hole so that the blow back is directed away from the marksman. One means of reducing the amount of blow back is to make the size of the flash hole relatively small so that only a minimal amount of escaping gas would traverse the flash hole. Doing this, however, also creates problems in that, especially when utilizing black powder, burnt powder deposits form in the flash hole and partially or totally clog it with residue. When this occurs there is a chance of a misfire or a hang fire—misfire being a result of failure of the igniting spark or flame from the percussion cap to ignite the main powder charge and the hang fire being the result of only partial ignition of the main powder charge.

In modern times the utilization of muzzle-loading weapons has met with great popularity as it provides the marksman with a nostalgic trip into the past and a challenge of his marksmanship ability. Since the above-discussed disadvantages realized by using a percussion cap have no real effect on the challenge presented to the marksman, the mitigation of these disadvantages will only inure to the marksman's safety and not detract from the reason that the marksman would utilize a firearm. This fact has been recognized in the prior art in recent years. See for example, U.S. Pat Nos. 3,780,464, 4,114,303, and 4,222,191. While the ignition mechanisms shown in these patents are alleged to overcome the disadvantages mentioned above when utilizing muzzle-loading weapons, they are complex in structure and inconvenient in use. For example, in U.S Pat. No. 4,114,303 a shot shell primer is utilized which relies upon a fraction-fit in an igniter barrel. It is easy to appreciate that such shot shell primer is subject to falling from the ignition barrel resulting in a misfire.

Therefore it is an object of this invention to provide an ignition system which can utilize conventional caps and primers and which requires structure which is the paragon of simplicity, but which, at the same time, prevents blow back and missiling of caps or primer fragments. Also by the utilization of the system of this invention, the flash hold can be dimensioned somewhat larger than in prior art systems as the blow back problem has been greatly reduced, if not totally eliminated.

THE INVENTION

This invention relates to a firing mechanism for installation in muzzle-loading firearms. The firing mechanism may include a drum having a threaded stud which is conveniently screwed into a threaded hole located adjacent the breech of the firearm. Along the long axis of the threaded stud there is provided a portion of an ignition path, which path will provide a route for a spark or fire from the ignition cap to reach the main powder charge. Another portion of the ignition path is also provided in the drum and may be at right angles to the first-described ignition path portion. The second portion of the ignition path terminates in a threaded port which is threaded to receive a cap holder. The cap holder has a threaded post which screws into the threaded port or a threaded recess in the firearm barrel which has an anvil in the bottom thereof. Along the long axis of the threaded post is a hollow cylinder which, in combination with the inside end wall of the threaded port, forms a chamber into which the percussion cap or shot shell primer will seat. Also provided in the cap holder is an aperture into which is slidably carried a firing pin. The firing pin has two ends, a striker end and an anvil end. The striker end slidably fits within the hollow cylinder and has an ignition boss thereon for striking the ignition cap or shot shell primer and causing same to fire. The anvil end is for impacting by the firearm's hammer.

As can be appreciated, since the chamber is closed except for opening to the ignition path, it is impossible to experience the type of blow back when utilizing conventional percussion cap mechanisms.

Clogging of the ignition path is prevented also by the firing mechanism of this invention as the gases from the ignition of the main powder charge cannot pass through the ignition path as the chamber in which the ignition cap is held is closed. Since there is no passage of gases through the ignition path to the atmosphere, there is avoided the drawbacks of the conventional percussion cap mechanisms, i.e. (1) the blowing of hot gases in the vicinity of the marksman's face which may cause injury to him or her, and (2) clogging of the ignition path with burnt powder residue. Also since the cap or primer is enclosed, there is no danger of fragments from these two ignition sources being blown in the vicinity of the marksman's face.

Furthermore, the firing mechanism of this invention can be used to ignite black powder and, in a properly designed barrel, smokeless powder. The use of smokeless powder eliminates the necessity of cleaning the barrel, which is a very laborious, dirty and time consuming task when black powder is used.

These and other features of this invention contributing to satisfaction in use and economy in manufacture will be more fully understood when taken in connection with the following description of a preferred embodiment and the accompanying drawings in which identical numerals refer to identical parts and in which.

Figure 1:
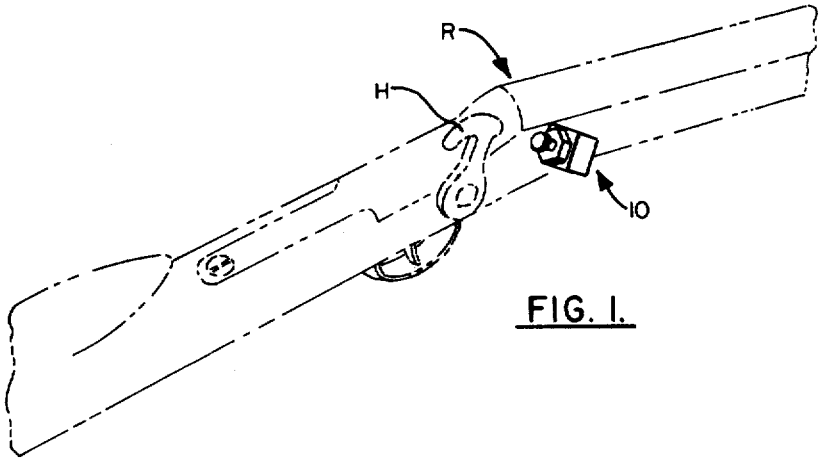
FIG. 1 is a perspective view of a firing mechanism of this invention attached to the breech of a muzzle-loading rifle.
Figure 2:
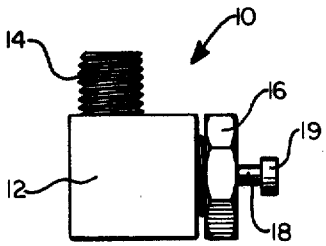
FIG. 2 is a side elevational view of the firing mechanism shown in FIG. 1.
Figure 3:
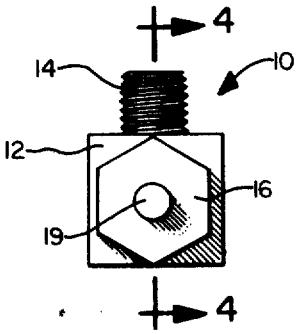
FIG. 3 is a front elevational view of the firing mechanism shown in FIG. 1.
Figure 4:
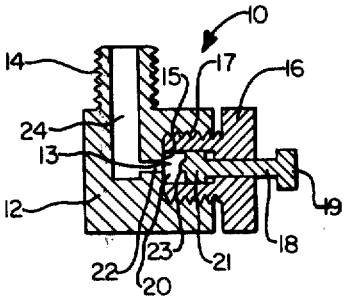
FIG. 4 is a sectional view taken through section lines 4—4 in FIG. 3.

Referring now to FIG. 1, there can be seen a firing mechanism of this invention, generally designated by the numeral 10, attached to a muzzle-loading rifle, generally designated by the letter "R". Firing mechanism 10 is attached to firearm "R" at a point adjacent the breech thereof. With reference to FIGS. 2–4 it can be seen that there is provided threaded stud 14 for achieving this attachment in a threaded recess in the barrel. This recess can be produced by conventional milling techniques. Should there already be a threaded recess for accommodation of conventional percussion cap mechanisms, threaded stud 14 can then be machined to a size to fit the threaded recess. Threaded stud 14 is integrally formed with drum 12. As can be seen in FIG. 4, threaded stud 14 and drum 12 have an ignition path cut therein. Ignition path 24 runs along the long axis of threaded stud 14 into the interior of drum 12. Connected to ignition path 24 is a second portion of the total ignition path, i.e. ignition path 22. This perpendicular relationship is preferred as the cap or primer is set in a position parallel with the long axis of the barrel so that a simplified structure for its ignition can be achieved as herein explained.

Drum 12 also has a threaded bore which is in communication with ignition paths 22 and 24. This relationship is shown in FIG. 4. The threaded bore is larger in diameter than ignition path 22 thereby providing inside end wall 15. The cap or primer will seat against inside end wall 15. Threaded into the threaded bore is cap holder 16. To achieve this threading cap holder 16 has a threaded post 17. Along the long axis of threaded post 17 there is provided hollow cylinder 13. Hollow cylinder 13 along with inside end wall 15 yields chamber 20. Cap holder 16 also has an aperture therethrough in communication with hollow cylinder 13 in which is slidably mounted firing pin 18. Firing pin 18 has an anvil end 19 and a striker end 21. Anvil end 19 has a configuration so that hammer "H," shown in FIG. 1, will impact firing pin 18 to drive it down into the inside of hollow cylinder 13. Striker end 21 has an ignition boss 23 to facilitate ignition of the cap or primer which will be held within chamber 20.

As can be seen, cap holder 16 has a hexagonal nut head configuration so that the marksman can snug cap holder 16 to drum 12 with a hand wrench. If it is desired to use hand tightening to achieve snugness, cap holder 16 can have a round knurled edge instead of the hexagonal nut head configuration.

As can be seen from the foregoing, chamber 20 is closed except for its communication with ignition paths 22 and 24. This closure of chamber 20 is accomplished in part by the utilization of firing pin 18 which is slidably mounted onto cap holder 16. As pressures build in the breech of firearm "R" any gases which attempt to blow back along ignition paths 22 and 24 will be thwarted in their escape to the atmosphere due to the sealing of hollow cylinder 13 by striker end 21 of firing pin 18.

It should also be noted that while the configuration of firing mechanism 10 shown in the drawings is a highly preferred configuration, there can also be certain modifications which do not deviate from the invention described herein. For example, drum 12 could be provided with a second threaded post which achieves attachment with the cap holder, which, instead of having a threaded post, has a threaded recess for threaded cooperation with the drum post. In other words, the threading cooperation is still provided in this modification but the threaded relationship is reversed from that which is shown in the drawings.

The geometry described thus far is for use in a firearm employing a drum and nipple type ignition or firing mechanism. The geometry would vary slightly for use with bolster type or underhammer type ignition mechanisms. For example, in an underhammer type ignition or firing mechanism, drum 12 could be modified to align threaded stud 14 and ignition path 24 with ignition path 22. Furthermore, drum 12 could be eliminated if the firearm barrel were modified to provide an anvil surface such as 15 and to accept cap holder 16.

The firing mechanism of this invention is made of conventional metals which are capable of withstanding the pressures and repeated uses encountered in the use of such types of firearms.

The ignition cap can be either a large or small rifle or pistol cartridge primer or shot shell primer. The embodiment shown in the drawings is especially designed for percussion caps such as rifle cartridge primers, pistol cartridge primers, shot shell primers, and the like. A slight modification of the size of inside end wall 15 may have to be made to facilitate use of different primers.

In operation firing mechanism 10 is the paragon of simplicity. The marksman merely removes cap holder 16 by unscrewing it from drum 12. The ignition cap, be it a large or small rifle or pistol cartridge primer or a shot shell primer, is placed inside hollow cylinder 13 and cap holder 16 is tightly fitted to drum 12 by screwing it thereon. Formed chamber 20 is thereby at least partially filled with the ignition cap. Firing pin 18 is then in the "Out" position. When the trigger on firearm "R" is pulled, hammer "H" falls and strikes firing pin 18 on its anvil end thereby driving striker end 21 onto the ignition cap causing it to fire. The resultant ignition results in fire or sparks being communicated to the main powder charge resulting in firing of firearm "R". After firing cap holder 16 is unscrewed and the ignition cap is removed by either pushing the anvil end 19 of firing pin 18 so that it is displaced from hollow cylinder 13 or if any resistance is encountered by this method of removal anvil 19 can be struck on any hand object to facilitate removal of the ignition cap.

Any substance which ignites upon impact or by percussion can be used in the firing mechanism of this invention. For example, the substance used in percussion caps for use in children's toy cap pistols could be used. Such substances could be placed in chamber 20 in powder form, or in the form of a solid disc or the like, and ignited by firing pin 18.

I claim

1. A firing mechanism for installation on a muzzle-loading firearm having a hammer, which mechanism comprises:

a. drum means having, i. an attachment means for attaching said drum means to said firearm adjacent the firearm breech, ii. an ignition path to provide a route for the ignition source of said firearm to a point adjacent a main powder charge in the interior of the barrel of said firearm, and iii. mounting means adjacent said ignition path, b. a cap holder means removably mounted to said mounting means for holding an ignition cap or priming substance adjacent said ignition path, said cap holder means having an aperture therethrough, and c. a firing pin slidably carried in said aperture, said firing pin having an anvil end and a striker end, said anvil end being adapted for being impacted by the hammer of the firearm and said striker end being adapted for striking said ignition cap or priming substance;

whereby said cap holder means, when mounted to said drum means, provides a closed chamber which is only open to said ignition path.

2. The firing mechanism of claim 1 wherein said attachment means is a threaded stud for cooperation with a threaded aperture in said firearm barrel to achieve said attachment.

3. The firing mechanism of claim 1 wherein said mounting means is a threaded bore in said drum means and said cap holder has a threaded post for cooperation with said threaded bore to achieve removable mounting, said post additionally having a portion along its center axis in which said striker end of said firing pin is free to move and which provides a portion of said closed chamber.

4. The firing mechanism of claim 2 wherein said ignition path extends along the center axis of said threaded stud into the interior of said drum means and then turns perpendicularly to said closed chamber.

5. The mechanism of claim 4 wherein said mounting means is a threaded bore in said drum means and said cap holder has a threaded post for cooperation with said threaded bore to achieve removable mounting, said post additionally having a portion along its center axis in which said striker end of said firing pin is free to move and which provides a portion of said closed chamber.

6. The firing mechanism of claim 3 wherein said attachment means is a threaded stud for cooperation with a threaded aperture in said firearm barrel to achieve said attachment.

7. A firing mechanism for installation on a muzzle-loading firearm having a hammer, said firearm having a threaded recess toward the rear end of the barrel, said recess having an anvil means in the lower end thereof and an ignition path from said anvil means to a point adjacent a main powder charge in the interior of the barrel of said firearm, which mechanism comprises:

a. cap holder means removably mounted to said firearm for holding an ignition cap or priming substance adjacent said ignition path, said cap holder means having an aperture therethrough, and b. a firing pin slidably carried in said aperture, said firing pin having an anvil end and a striker end, said anvil end being adapted for being impacted by the hammer of the firearm and said striker end being adapted for striking said ignition cap;

whereby said cap holder means, when mounted to said barrel, provides a closed chamber which is only open to said ignition path.

8. The firing mechanism of claim 7 wherein said ignition path extends along the center axis of said cap holder means into the interior of said firearm barrel.

9. The mechanism of claim 8 wherein said cap holder has a threaded post for cooperation with said threaded recess to achieve removable mounting, said post additionally having a portion along its center axis in which said striker end of said firing pin is free to move and which provides a portion of said closed chamber.

* * * * *